US007614670B2

(12) United States Patent
Hayakawa et al.

(10) Patent No.: US 7,614,670 B2
(45) Date of Patent: Nov. 10, 2009

(54) DOOR CLOSING APPARATUS

(75) Inventors: Shigeru Hayakawa, Chiryu (JP); Motohiro Kokubo, Kariya (JP); Toshitsugu Oda, Okazaki (JP); Tsutomu Kobayashi, Toyohashi (JP); Nobuko Watanabe, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 237 days.

(21) Appl. No.: 11/598,088

(22) Filed: Nov. 13, 2006

(65) Prior Publication Data

US 2007/0120378 A1 May 31, 2007

(30) Foreign Application Priority Data

Nov. 17, 2005 (JP) ..... 2005-333263

(51) Int. Cl.
*E05C 3/06* (2006.01)

(52) U.S. Cl. ..... 292/216; 292/201; 292/DIG. 23

(58) Field of Classification Search ..... 292/201, 292/216, DIG. 23, DIG. 64, DIG. 53; 403/DIG. 8, 403/62, 161–162
See application file for complete search history.

(56) References Cited

U.S. PATENT DOCUMENTS 6,168,216 B1 1/2001 Nakajima et al.
2005/0099016 A1* 5/2005 Inoue ..... 292/216

FOREIGN PATENT DOCUMENTS

JP 3315068 B2 6/2002

* cited by examiner

*Primary Examiner*—Carlos Lugo
*Assistant Examiner*—Kristina R Fulton
(74) *Attorney, Agent, or Firm*—Buchanan Ingersoll & Rooney PC

(57) ABSTRACT

A door closing apparatus includes a latch mechanism operated for opening or closing a door of a vehicle, a driving mechanism transmitting a driving force to the latch mechanism to operate the latch mechanism, a first lever rotatably disposed about a first rotational axis and rotating in one direction in response to transmission of an operation force of a door handle to the first lever so that the latch mechanism is controlled at the unlatched state, a second lever having an engaging portion which engages with the first lever and rotatably disposed about a second rotational axis being different from the first rotational axis. The second lever rotates in the one direction about the second rotational axis in response to a rotation in the one direction of the first lever to interrupt transmission of the driving force from the driving mechanism to the latch mechanism.

13 Claims, 9 Drawing Sheets

DOOR CLOSING APPARATUS

CROSS REFERENCE TO RELATED APPLICATIONS

This application is based on and claims priority under 35 U.S.C §119 with respect to Japanese Patent Application 2005-333263, filed on Nov. 17, 2005, the entire content of which is incorporated herein by reference.

FIELD OF THE INVENTION

The present invention relates to a door closing apparatus for a vehicle.

BACKGROUND

Conventionally, a door closing apparatus transmits a driving force of an driving mechanism to a latch mechanism to operate the latch mechanism in a half latched state to a full latched state for closing a vehicle door at a half closed position to a full closed position. For example, the door closing apparatus disclosed in Japanese Patent 3315068 is known. In the door closing apparatus, an operational force is transmitted to an open lever and for rotating the open lever about an axis. Consequently, a latch mechanism is put into an unlatched state. Moreover, in response to the rotation of the open lever, a link mechanism swings to rotate a lever connected thereto via a wire and transmission of the driving force between the driving mechanism and the latch mechanism is blocked. Therefore, a closing operation of a vehicle door is halted and can be opened. The link mechanism is used for adjusting (or increasing) a rotational distance (stroke) of the lever relative to a rotational distance (stroke) of the open lever within an allowable range of the rotational distance (stroke) of the open lever for putting the latch mechanism into the unlatched state in order to block the transmission of the driving force from the driving mechanism to the latch mechanism.

According to Japanese Patent 3315068, blocking of the driving force between the driving mechanism and the latch mechanism, which associated with the rotation of the open lever, is conducted via multiple links. Thus, the increase in the number of parts and the increase of the production processes are unavoidable. In addition, in order to arrange these links, flexibility of an arrangement for an entire apparatus is restricted.

The present invention has been made in view of the above circumstances, and provides a door closing apparatus which is able to restrict the increase in the number of the components and the increase of the production processes.

SUMMARY OF THE INVENTION

According to an aspect of the present invention, a door closing apparatus includes a latch mechanism operated for opening or closing a door of a vehicle, the latch mechanism being at a half latched state at a time that the door is half closed, the latch mechanism being at a full latched state at a time that the door is fully closed, and the latch mechanism being at an unlatched state at a time that the door is open, a driving mechanism transmitting a driving force to the latch mechanism to operate the latch mechanism, a first lever rotatably disposed about a first rotational axis and rotating in one direction about the first rotational axis in response to transmission of an operation force of a door handle to the first lever so that the latch mechanism is controlled at the unlatched state, a second lever having an engaging portion which engages with the first lever and rotatably disposed about a second rotational axis being different from the first rotational axis, the second lever rotating in the one direction about the second rotational axis in response to a rotation in the one direction of the first lever to interrupt transmission of thee driving force from the driving mechanism to the latch mechanism.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
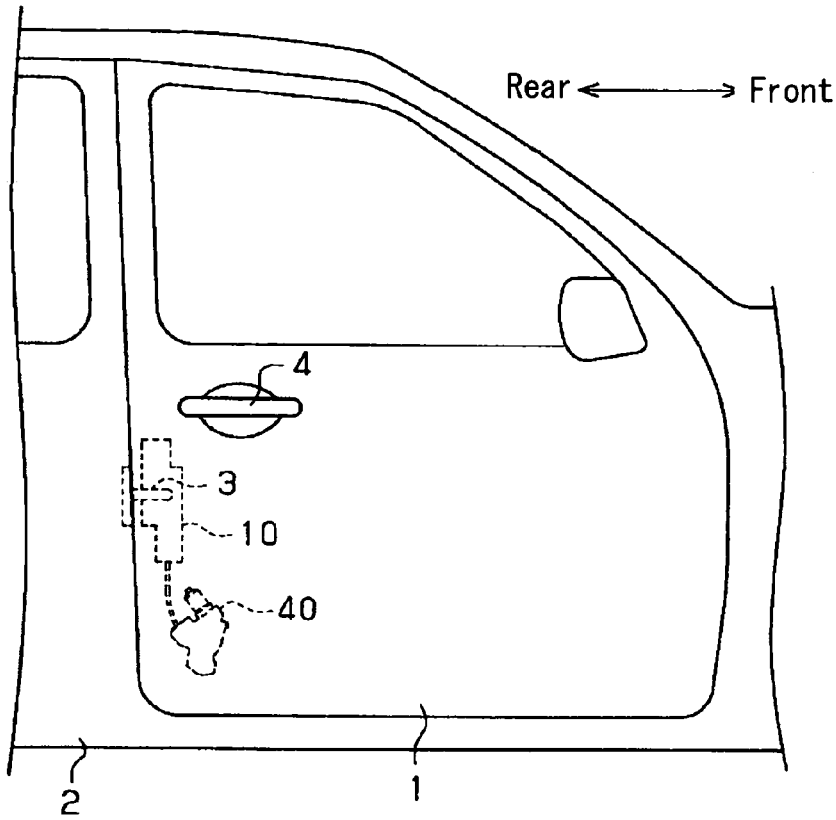
FIG. 1 is an front view illustrating a vehicle door 1 to which the invention is applied.
Figure 2:
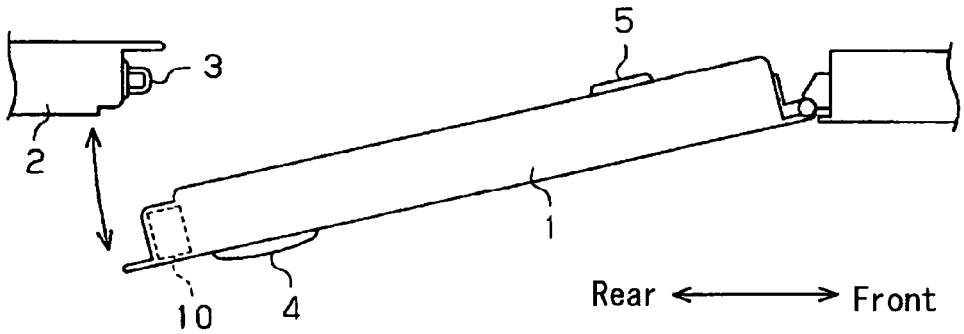
FIG. 2 is a plain view illustrating a vehicle door.

An embodiment of the present invention will be described below with reference to the attached drawings. FIG. 1 is a front view illustrating a vehicle door 1 to which the invention is applied and FIG. 2 is a plain view thereof. As illustrated in FIG. 2, the vehicle door 1 is a so called swing type door which is hinged to a vehicle body 2 (a main body of the vehicle) to open and close a door opening. A door latch device 10 is mounted at an end portion of a vehicle rear side. The door latch device 10 holds the vehicle door 1 in a half closed state or a full closed state by engaging with a U shaped type striker 3. The striker 3 is fixed to the vehicle body 2 side. The door latch device 10 is connected to an outside door handle 4 and an inside door handle 5 which are respectively disposed inside and an outside of the vehicle door 1. An operational force is transmitted from either the door handle 4 or the door handle 5 and an engagement with the striker 3 is released to allow the vehicle door 1 to be openable.

Further, the door latch device 10 is connected to an actuator 40 which is a driving mechanism mounted in the vehicle door 1. When the driving force of the actuator 40 is transmitted, the door latch device 10 is engaged with the striker 3 so that the vehicle door 1 in the half closed state is operated to be in the full closed state. The actuator 40 is operatively connected to the door handle 4 and the door handle 5. The operational force is transmitted from either the door handle 4 or the door handle 5 to block the transmission of the driving force to the latch mechanism 20.

Figure 3:
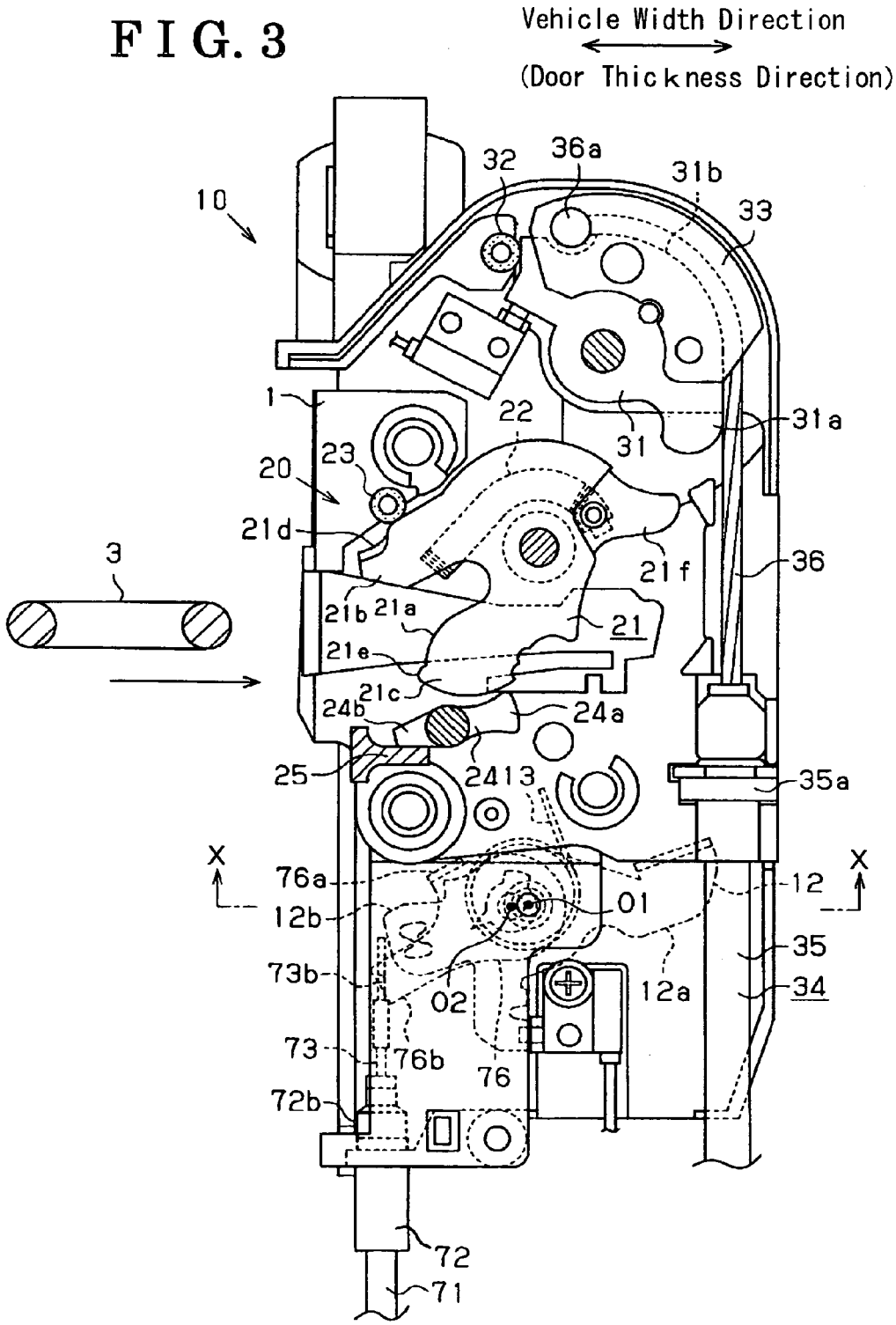
FIG. 3 is a front view illustrating a door latch device.
Figure 4:
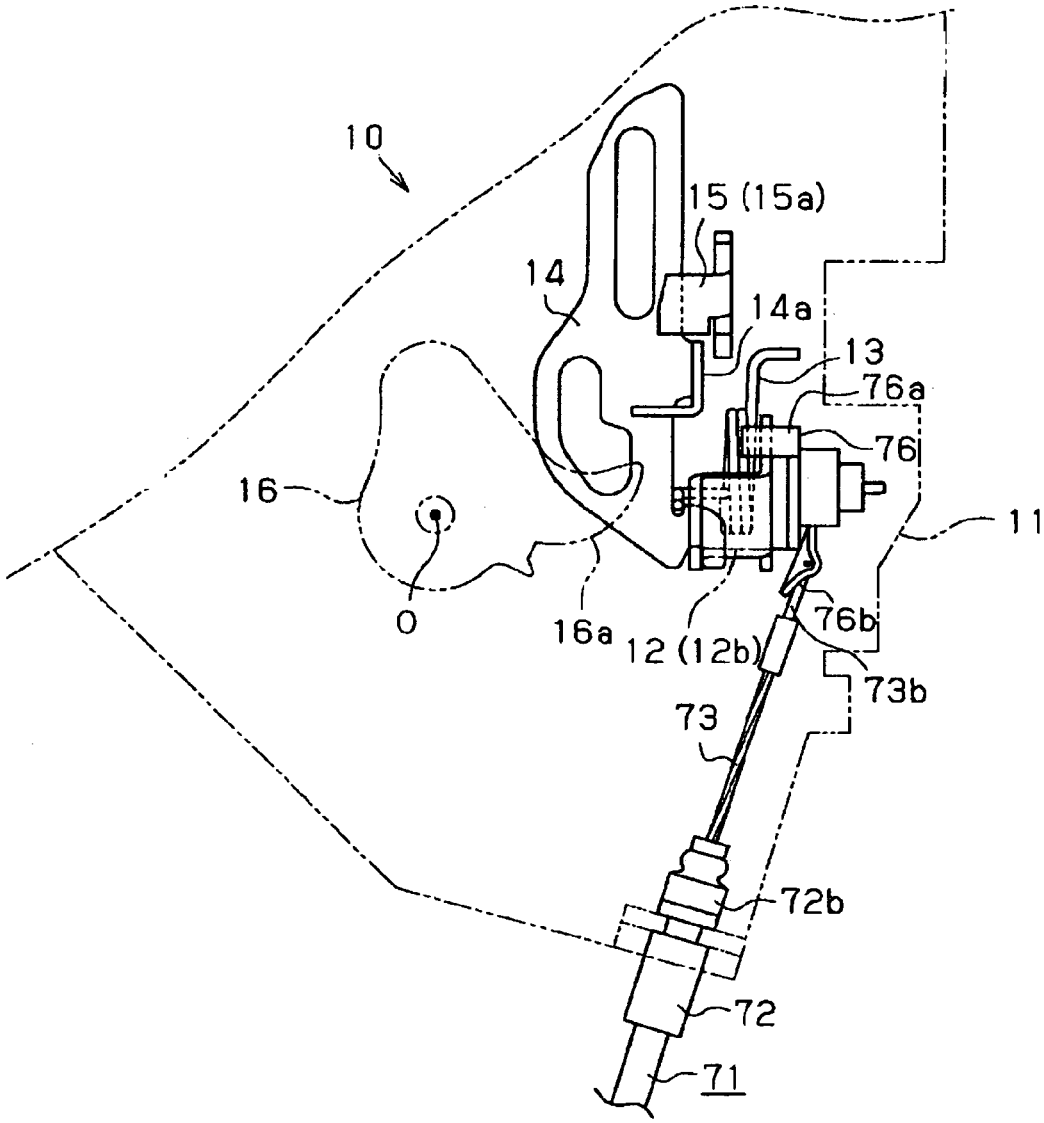
FIG. 4 is a side view illustrating the door latch device.

Secondly, a structure of the door latch device 10 will be described with reference to FIG. 3 to FIG. 6. FIG. 3 is a front view and FIG. 4 is a side view of the door latch device 10. These figures respectively correspond to a view viewed from a rear side of the vehicle and a view viewed from an inside of a vehicle in a width direction. As illustrated in the figures, a main body portion 11 forms an outer profile of the door latch devise 10, and houses or supports various components therein. In the main body portion 11, an open lever 12, which is a first lever member made of a plate material, is rotatably supported around a first rotational axis 01. The open lever 12 is supported in a predetermined rotational position with the open lever 12 being biased by a torsion spring 13 coiled around the first rotational axis 01. The open lever 12 is connected to the outside door handle 4 via a known coupling member at an end portion 12*a* located on one side of the open lever 12 (the right side of FIG. 3). The operational force of the outside door handle 4 is transmitted to rotate the open lever 12 in a clockwise direction in the figure against the torsion spring 13 to raise an end portion 12*b* positioned on the other side of the open lever 12. (the left side of FIG. 3) When the operational force of the outside door handle 4 is released, the open lever 12 is biased by the torsion spring 13 to rotate in a counterclockwise direction and lower the end portion 12*b*. Thus, the open lever 12 returns to the predetermined rotational position.

As illustrated in FIG. 4, in the end portion 12*b* of the open lever 12, a lower end of an open link 14 is supported for swing the open link 14. In addition, an L shaped flange 14*a* formed in an intermediate portion of the open link 14 in a horizontal direction is arranged in a way that the flange 14*a* can face a tip portion 15*a* of a lift lever 15 from a lower side. The lift lever 15 is formed by a plate material which is rotatably supported by the main body portion 11.

Furthermore, an inside open lever 16, which is made of a plate material, is supported by the main body portion 11 in the state that the inside open lever 16 can rotate on a rotational axis 0. A tip portion 16*a* of the inside open lever 16 extends to a radially outer side of the open lever 16 and is arranged in a way that the tip portion 16*a* can face the flange 14*a* from a lower side. Moreover, the inside open lever 16 is connected to the inside door handle 5 via a known coupling member and the operational force of the inside door handle 5 is transmitted. The inside open lever 16 rotates in a counterclockwise direction in the figure to raise the tip portion 16*a*. When, the operational force of the inside open lever 16 is released, the inside open lever 16 rotates in a clockwise direction in the figure to lower the tip portion 16*a*. The inside open lever 16 is biased up to an initial position of the open link 14 by the torsion spring 13. The inside open lever 16 is then biased up to an initial position by the operation of the inside door handle 5 and returns to a predetermined rotational position.

As illustrated in FIG. 3, in the main body portion 11, a latch 21 is rotatably supported at the upper side of the open lever 12 and formed in a U shape having an engaging recessed portion 21*a*. The latch 21 is formed with a first detent portion 21*b* and a second detent portion 21*c*. The first detent portion 21*b* is formed on one side (the side in a clockwise direction of FIG. 3) and the second detent portion 21*c* are formed on the other side (the side in the counterclockwise direction of FIG. 3) with respect to the engaging recessed portion 21*a*. In a tip portion of the first detent portion 21*b*, a first engaging portion 21*d* is formed on the latch 21 at an opposite side of the engaging recessed portion 21*a*. In a tip portion of the second detent portion 21*c*, a second engaging portion 21*e* is formed on the latch 21 at the engaging recessed portion 21*a* side. The latch 21 is further formed with a projecting follower 21*f* extending toward the opposite side of the engaging recessed portion 21*a* relative to a rotational axis. One end of the latch biasing spring 22, which is held to the main body portion 11 at the other end, engages with the latch 21. Subsequently, the latch 21 is biased in a direction where the latch 21 rotates in a clockwise direction. An opposing surface of the first detent portion 21*b* engages with a latch stopper 23 located in the main body portion 11. Thus, the rotation in the clockwise direction is restricted and the latch 21 is held in a predetermined position.

Additionally, in the main body portion 11, a pawl 24 is rotatably supported between the open lever 12 and the latch 21. The pawl 24 is connected to the lift lever 15 so that the pawl 24 can unitary rotate with the lift lever 15. The pawl 24 is formed with an engaging end portion 24*a* and an extending end portion 24*b*. The engaging end portion 24*a* extends to one side (the left side of FIG. 3) and the extending end portion 24*b* (right side of FIG. 3) extends to the other side relative to a rotational axis. One end of a pawl biasing spring (not shown in the figure), which is held to the main body portion 11 at the other side, engages with the pawl 24. Thus, the pawl 24 is biased in a counterclockwise direction in where the pawl 24 rotates, namely, the direction where the engaging 24*a* is raised. An opposing surface of the extending end portion 24*b* contacts a pawl stopper 25 located in the main body portion 11 and the rotation in the counterclockwise direction is adjusted to hold the pawl 24 in a predetermined position. The pawl 24 forms a latch mechanism 20 along with the latch 21 and other components.

A basic operation of the latch mechanism 20 will be explained. In the state that the vehicle door 1 opens, as illustrated in FIG. 3, the opposing surface of the first detent portion 21*b* contacts the latch stopper 23. Thus, the latch 21 is held at the predetermined rotational position and the engaging recessed portion 21*a* opens to an insertion passage of the striker 3 for closing operation of the vehicle door 1. The opposing surface of the extending end portion 24*b* contacts the pawl stopper 25. Thus, the pawl 24 is rotatably held at the predetermined position and the engaging end portion 24*a* is arranged at the lower side of the second detent portion 21*c*. This operation state of the latch mechanism 20 is referred to as an unlatched state.

Figure 5:
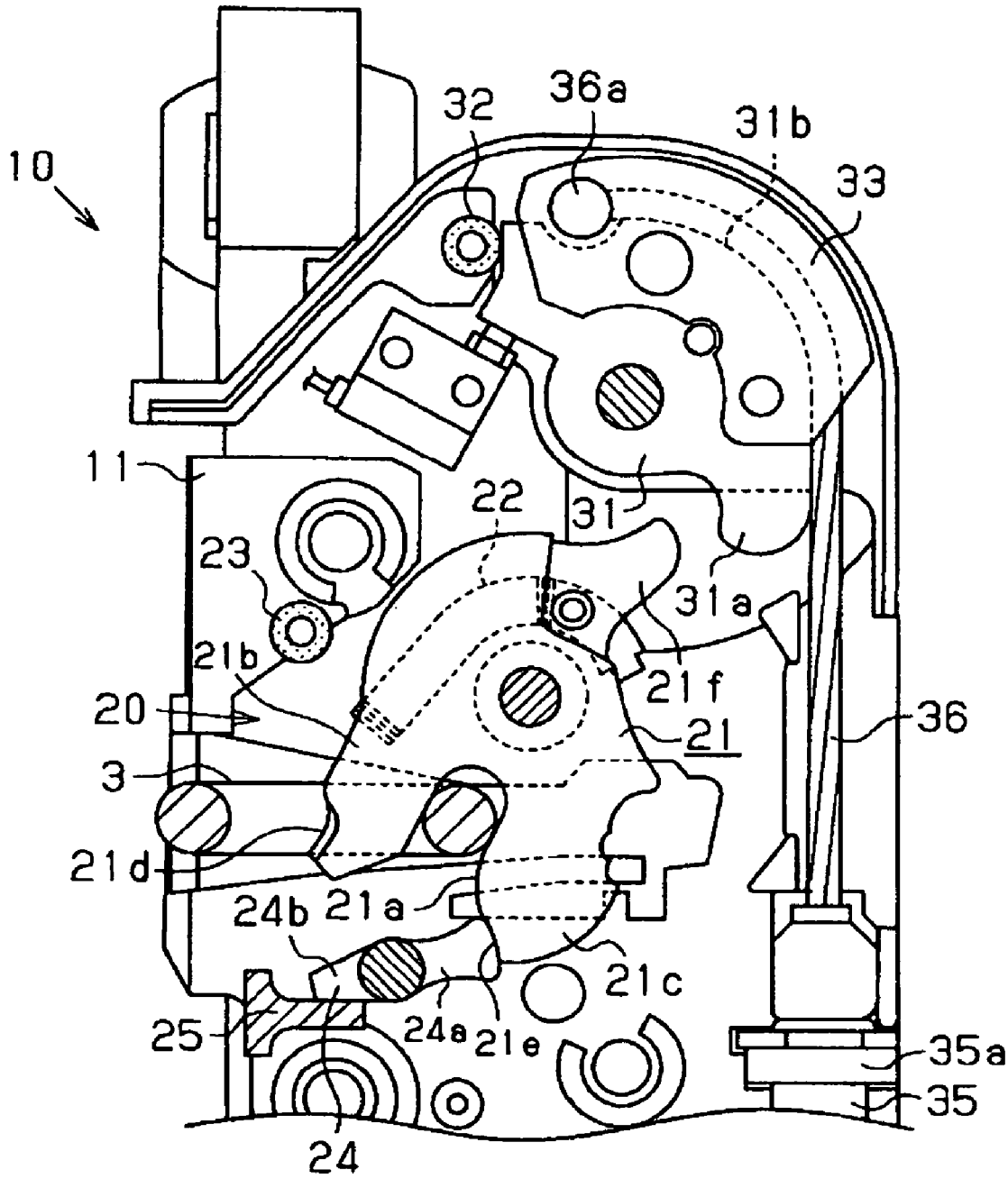
FIG. 5 is a front view illustrating the door latch device.

Secondly, in response to the closing operation of the vehicle door 1, the striker 3 is inserted into the engaging recessed portion 21*a*, an inner wall surface of the engaging recessed portion 21*a* is pressed by the striker 3. As illustrated in FIG. 5, the latch 21 rotates in a counterclockwise direction of the figure against the latch biasing spring 22 and the rotation is stopped by the engagement of the second engaging portion 21*e* with the engaging end portion 24*a*. At this moment, the vehicle door 1 is in a half closed state wherein the vehicle door 1 engages with the striker 3 at the engaging recessed portion 21*a* to prevent the striker 3 from disengagement with the vehicle door 1. The latch mechanism 20 in this state is referred to as a half latched state.

Figure 6:
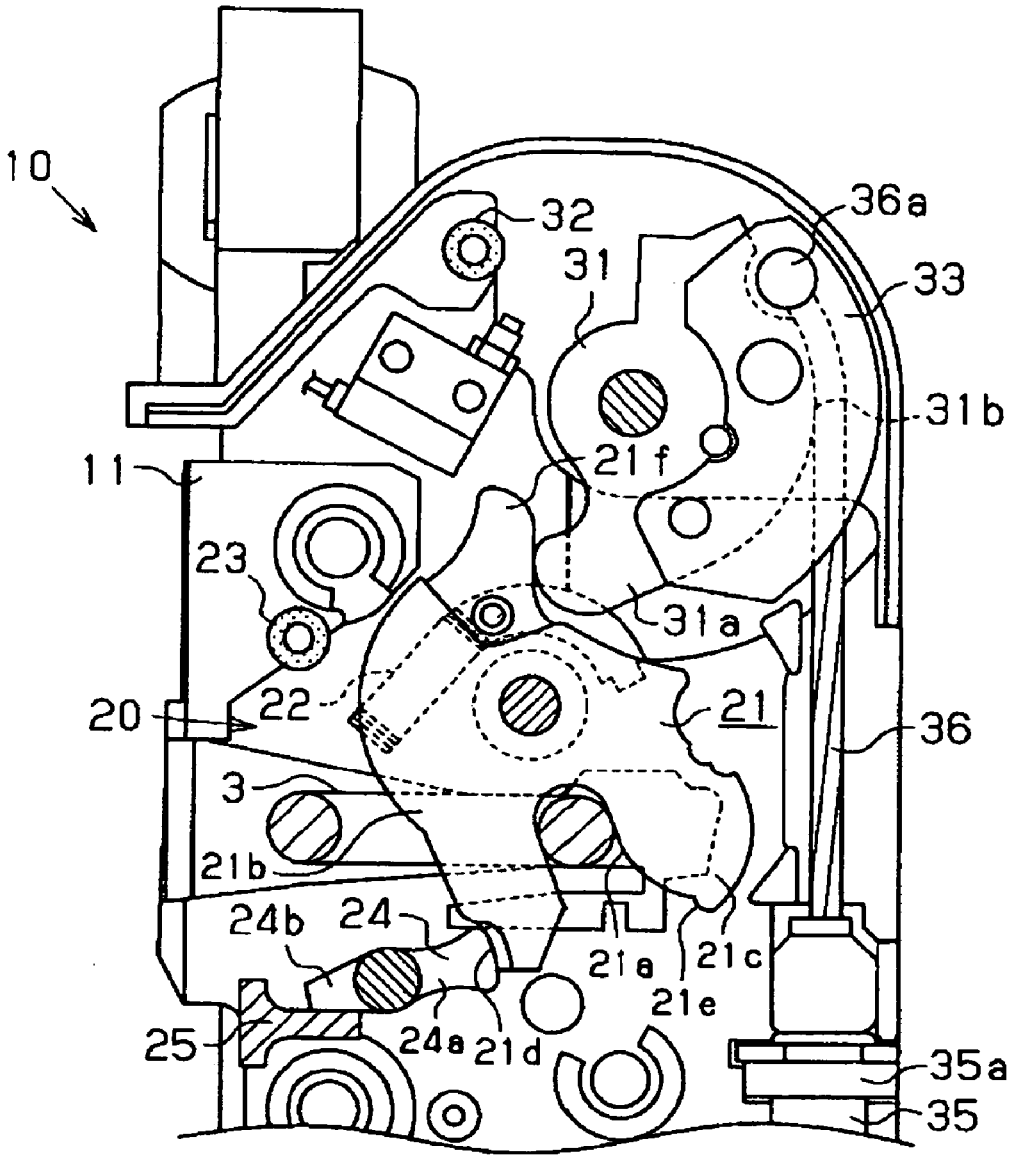
FIG. 6 is a front view illustrating the door latch device.

Subsequently, in response to further operation for closing the vehicle door 1, the striker 3 moves into the insertion passage, the inner wall of the engaging recessed portion 21*a* is pressed by the striker 3. Consequently, as illustrated in FIG. 6, the latch 21 further rotates in the counterclockwise direction of the figure against the latch biasing spring 22 and the rotation is stopped by the engagement of the first engaging portion 21*d* with the engaging end portion 24*a*. In this moment, the vehicle door 1 is in a full closed state wherein the vehicle door 1 engages with the striker 3 at the engaging recessed portion 21*a* to prevent the striker 3 from disengagement with the vehicle door 1. The latch mechanism 20 in this state is referred to as a full latched state.

Furthermore, in the half latched state or the full latched state described above, when the pawl 24 rotates in the clockwise direction in the figure against the pawl biasing spring, the engagement of the engaging end portion 24*a* with either the first engaging portion 21*d* or the second engaging portion 21*e* is released. At this moment, the latch 21 is biased by the latch biasing spring 22 and rotates in the clockwise direction pressing the striker 3 by the inner wall of the engaging recessed portion 21*a*. Then, the vehicle door 1 is disengaged with the striker 3 at the engaging recessed portion 21*a* and becomes openable.

As illustrated in FIG. 3, in the main body portion 11, an operational lever 31 is rotatably supported by the main body portion 11 at the upper side of the latch 21. A driving projecting portion 31*a* extending toward one side (the lower side in FIG. 3) is formed in the operational lever 31. One end of the lever biasing spring (not shown in the figure) is supported by the main body portion 11 and the operational lever 31 is engaged with the other end of the lever biasing spring. Thus, the operational lever 31 is biased in a direction where the operational lever 31 rotates in a counterclockwise direction. A rotation of the operational lever 31 in the counterclockwise direction is restricted by contacting a lever stopper 32 located in the main body portion 11 to hold the operational lever 31 in a predetermined position. The driving projecting portion 31*a* is positioned so that the projecting follower 21*f* is arranged on a rotational path of the operational lever 31 (Refer to FIG. 5) when the latch mechanism 20 is in the half latched state.

The operational lever 31 is further formed with an arc-shaped guide surface 31*b* at an upper side of the rotational axis, and two guide plates 33 (only one plate is illustrated in FIG. 3) made of a plate material are secured to the operational lever 31 with the guide plates 33 sandwiching the guide surface 31*b*. In the main body portion 11, an end portion 35*a* of an outer tube 35 forming a driving cable 34 is held at the lower side of the operational lever 31. These guide plates 33 secure an end 36*a* of a driving wire 36 which is pulled from the end portion 35*a* to be guided to the guide surface 31*b*. Therefore, when the driving wire 36 is pulled into the end portion 35*a*, the operational lever 31 to which the guide plates 33 are secured rotates in a clockwise direction of the figure against the lever biasing spring. The driving wire 36 (the driving cable 34) is connected to the actuator 40. When the driving force of the actuator 40 is transmitted, the driving wire 36 is pulled into the end portion 35*a* so that the operational lever 31 rotates in the clockwise direction of the figure.

In the half latched state of the latch mechanism 20 illustrated in FIG. 5, when the driving wire 36 is pulled, the operational lever 31 rotates in the clockwise direction of the figure. The operational lever 31 then presses the projecting follower 21*f* of the latch 21 at the driving projecting portion 31*a*. Thus, the latch 21 rotates in a counterclockwise direction in the figure against the latch biasing spring 22. Consequently, the striker 3 which engages with the engaging recessed portion 21*a* is pulled to bring the latch mechanism 20 into the full latch state. At this moment, the vehicle door 1 performs the closing operation from the half closed state to the full closed state.

Figure 7:
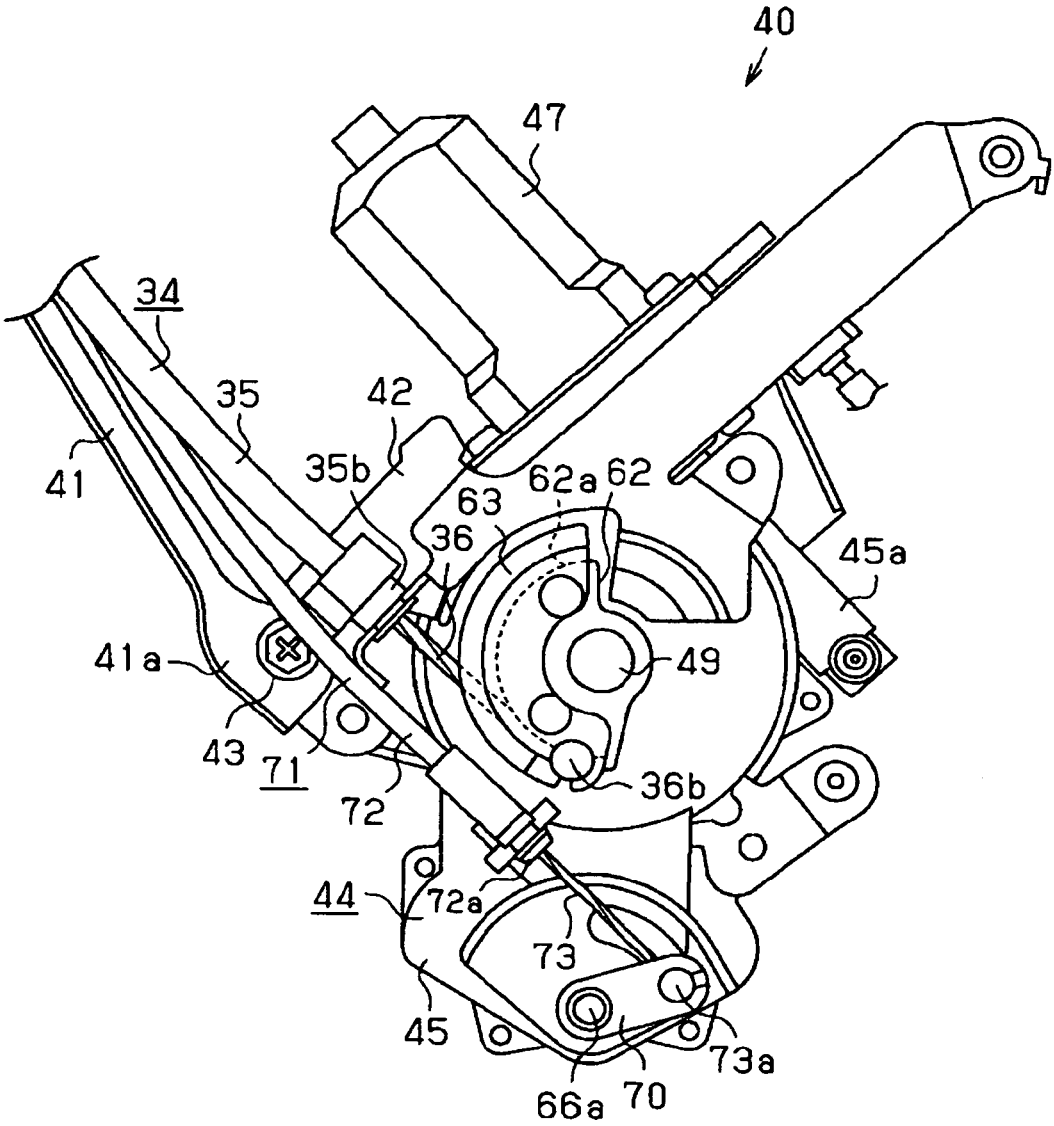
FIG. 7 is a front view illustrating an actuator.
Figure 8A:
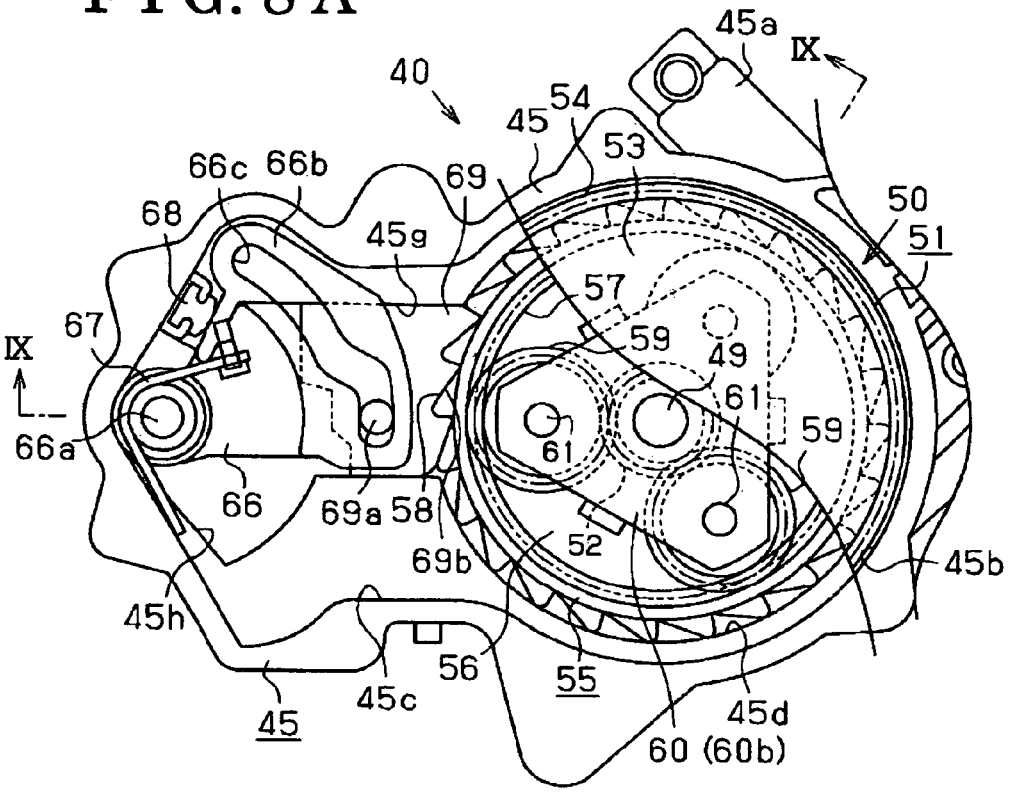
FIGS. 8 (*a*) and (b) are rear side views illustrating the actuator.
Figure 8B:
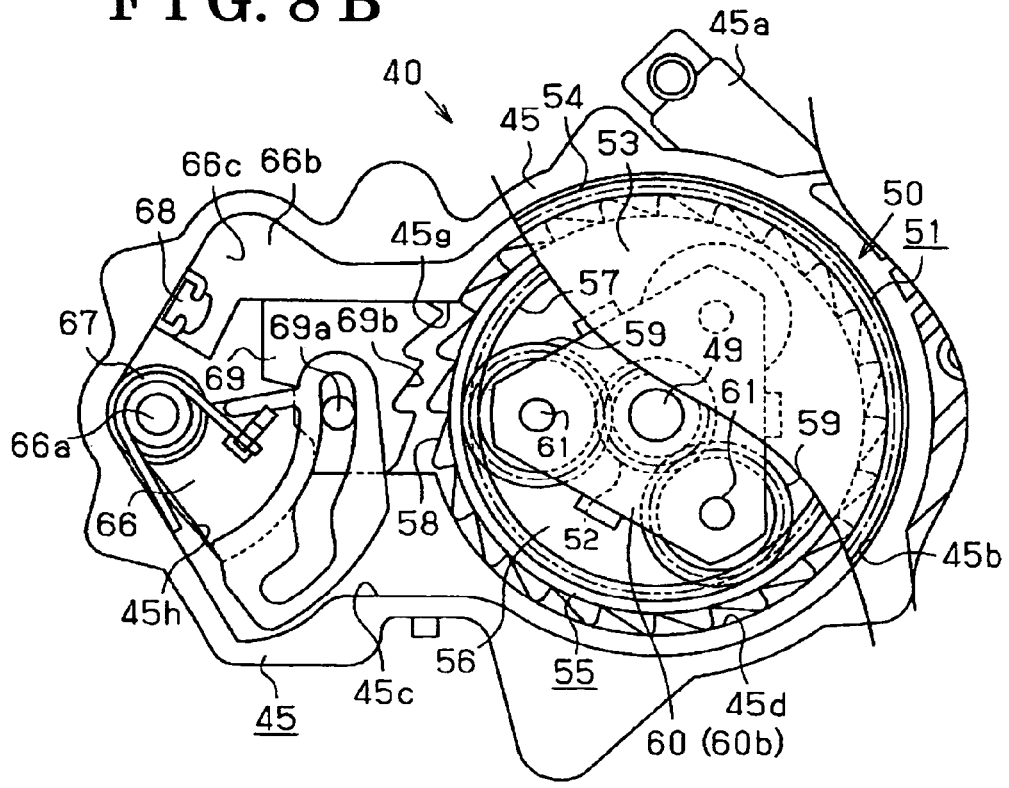
Figure 9:
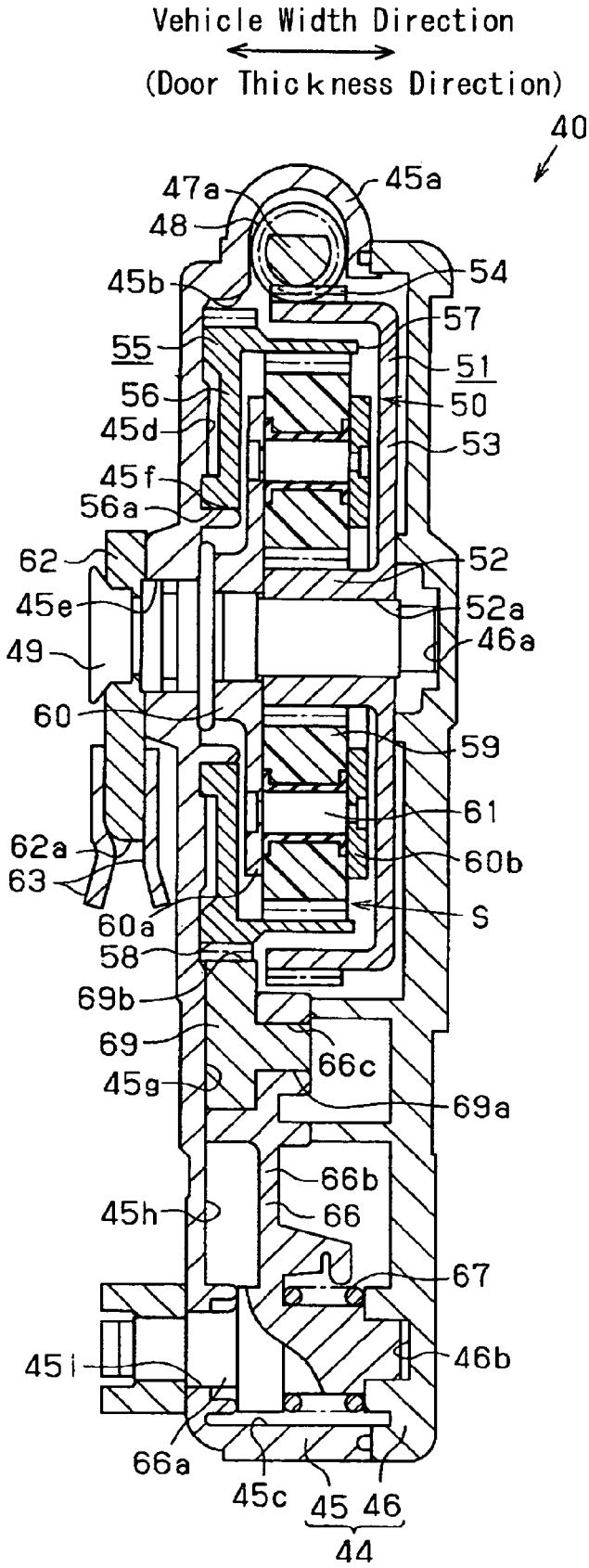
FIG. 9 is a cross sectional view taken from a line IX-IX of FIG. 8.

Next, a structure of the actuator 40 will be described with reference to FIG. 7 to FIG. 9. FIG. 7 is a front view of the actuator 40 and viewed from the outer side in a vehicle width direction illustrating how the actuator 40 is arranged. FIG. 8 is a rear side view of the actuator 40 and FIG. 9 is a cross sectional view taken along a line IX-IX of FIG. 8. As illustrated in FIG. 7, a bracket 41 formed in an elongated shape by a plate material at an end portion 41*a* of the bracket 41 is connected to a support bracket 42 with a screw 43. The other end of the bracket 41 is fixed to the main body portion 11 of the latch device 10 by a fastening means. (Not shown in the figure) The actuator 40 is secured to and supported by the door latch device 10 by fastening a box shaped housing 44 to the support bracket 42 via the bracket 41. The housing 44 forms an outer shape of the actuator 40 and houses and supports various components of the actuator 40. As illustrated in FIG. 9, the housing 44 has a cup shaped case 45 and a cover 46. The case 45 defines a housing space for the various components and the cover 46 blocks an opening of the case 45.

As illustrated in FIG. 7 and FIG. 9, the case 45 extends an axis in one direction (the right lower direction of FIG. 7) at one end portion (the right upper side of FIG. 7) and is formed with a cylindrical worm encasement 45*a* which partially opens to the housing space side. (the lower side of FIG. 9) In the worm encasement 45*a*, a worm 48 is rotatably housed. The worm 48 is secured to a rotational shaft 47*a* (Refer to FIG. 9) of an electric motor 47 fixed to the case 45 by fastening. The electric motor 47 is driven and controlled by a controller (not illustrated) to rotate the rotational shaft 47*a* (worm 48) in a normal direction or a reversing direction.

As illustrated in FIG. 8 and FIG. 9, the case 45 is formed with a gear encasement 45*b* having a cup shape cylindrical form by cutting a part of cylindrical portion of the worm encasement 45*a*. The gear encasement 45*b* is molded so that one side of the cylindrical form in a radial direction (the left side of FIG. 8) opens. The case 45 is further formed with an encasement 45*c* formed in a polygonal cup shape in a manner that the encasement 45*c* is continuous with the opening side of the gear encasement 45*b* (the left side of FIG. 8). In other words, a bottom wall of the case 45 presents in a combination of circular and polygonal shapes.

The gear encasement 45*b* is formed with a recessed portion 45*d* which has a smaller internal diameter than an internal diameter of the gear encasement 45*b* and is roundly recessed from the bottom wall. The gear encasement 45 is further formed with a bearing hole 45*e* in a central portion of the bottom wall (Refer to FIG. 9). One end of an output shaft 49 whose axial line extends along a central line of the encasement 45 is rotatably inserted into the bearing hole 45*e* and a tip portion of the output shaft 49 is projected outward from the case 45 (the housing 44). The other end of the output shaft 49 is rotatably supported on a recessed portion 46*a* which is formed on the cover 46 and immovably supported to one side in an axial direction. (The right side of FIG. 9)

In the gear encasement 45*b*, a sun gear 51 is housed on the side where the cover 46 is positioned. The sun gear 51 is formed with a cylindrical sun gear portion 52 having an internal diameter which is equivalent to an external diameter of the output shaft 49 and a disc shaped flange 53 extending radially outward at one end of the sun gear portion 52 in the axial direction (the right side of FIG. 9). The sun gear 51 is further formed with a cylindrical worm wheel portion 54 extending from a peripheral portion of the flange 53 to the other side in the axial direction (the left side of FIG. 9) to fit into the worm 48. The sun gear 51 forms a box shaped portion by the sun gear portion 52, the flange portion 53 and the worm wheel portion 54 and defines an annular housing space S. An inner circumference of the sun gear 52 is formed with a bearing hole 52*a* into which the output shaft 49 is fitted so as to allow relative rotation therebetween. The sun gear portion 52 is formed so that the axial position of the sun gear portion 52 lays over the axial position of the worm wheel portion 54.

The recessed portion 45*d* is formed with a projecting wall 45*f* having a common axis with the bearing hole 45*e* and projecting in a cylindrical form to the direction where the cover 46 is positioned and a ring gear 55 is rotatably supported in the projecting wall 45*f*. The ring gear 55 has an external diameter which is smaller than each internal diameter of the worm wheel 54 and the recessed portion 45*d* and is formed in a cup shape. The ring gear 55 is formed with an annular bottom wall portion 56 having a bearing hole 56*a* into which the projecting wall portion 45*f* is inserted and a cylindrical ring gear portion 57 extending from an peripheral portion of the bottom wall portion 56 to one side in the axial direction (the right side of FIG. 9). The ring gear portion 57 is disposed in a way that the axial position of the ring gear portion 57 lays over the axial position of the sun gear portion 52 with the tip portion of the ring gear portion 57 housed in the housing space S. Further, a plurality of engaging detents 58 is formed on a proximal side which is not aligned with the axial position of the worm wheel portion 54. The engaging detents 58 are formed in a predetermined pitch over an entire circumference in a circumference surface of the ring gear portion 57.

Multiple (Three) planet gears 59 are disposed at each predetermined angle between the sun gear portion 52 and the ring gear portion 57. Each planet 59 gear engages with the sun gear portion 52 and the ring gear portion 57. It is obvious that the planet gears 59 should be arranged so that the position in an axial direction of each planet gear 59, the position in an axial direction of the sun gear portion 52 and the position in an axial direction of the ring gear portion 57 overlap each other. A carrier 60 is secured to the output shaft 49 in the axial position which the output shaft 49 slidably contacts a tip portion of the sun gear portion 52. Each planet gear 59 is sandwiched by plates 60*a* and 60*b* forming the carrier 60 from both sides in an axial direction. Each supporting shaft 61 is held to each plate 60*a* at one end and is held to each plate 60*b* at the other end. Each supporting shaft 61 is fitted into each planet gear in the axial direction. Thus, each planet gear 59 is rotatably supported around the supporting shaft 61. Therefore, each planet gear 59 can rotate about the supporting shaft 61. In response to the rotation, the planet gear 59 revolves around the output shaft 49 along the ring gear portion 57. At the time, the carrier 60 unitary rotates with the output shaft 49.

A planet gear mechanism 50 is formed by the sun gear 51 (the sun gear portion 52), the ring gear 55 (the ring gear portion 57), the planet gears 59 and the carrier 60. As illustrated in FIG. 7, a segment-shaped driving lever 62 made of a plate material is fixed to the tip portion of the output shaft 49 extending outward from the housing 44 and an arc-shaped guide surface 62*a* is formed on the driving lever 62. Additionally, two guide plates 63 (one plate is shown in FIG. 7) are secured to the driving lever 62 with the guide plates 63 sandwiching the guide surface 62*a*. An end portion 35*b* of the outer tube 35 forming the driving cable 34 is supported by the support bracket 42 on one side of the driving lever 62. (the left side of the FIG. 7) These guide plates 63 support another end 36*b* of the driving wire 36 which is pulled from the end portion 35*b* and guided by the guide surface 62*a*. Therefore, when the driving lever 62 rotates in one direction (the counterclockwise direction of FIG. 7) along with the output shaft 49, the driving wire 36 is pulled from the end portion 35*b*. At this time, it is obvious that the driving wire 36 which is held on a side where the operational lever 31 is located is pulled into the end portion 35*a*. In other words, the driving lever 62 forms a power transmitting means along with the driving cable 34, the operational lever 31 and other components.

The encasement 45*c* is formed with a guide groove 45*g* which is continuous with one side of the recessed portion 45*d* in a radial direction (the left side of FIG. 8) and extends in a rectangular form along the direction. The encasement 45*c* is further formed with a lever side recessed portion 45*h* which is segment-shaped and continuous with a tip portion of the guide groove 45*g*. As illustrated in FIG. 9, the lever side recessed portion 45*h* is formed with a bearing hole 45*i* in the central portion of the segment-shape. One end of a lever shaft 66*a* which is integrally formed in a cancel lever 66 is rotatably inserted into the bearing hole 45*i* and the tip portion projects outward from the case 45 (the housing 44). The other end of the lever shaft 66*a* is rotatably supported by the recessed portion 46*b* formed on the cover 46 in a way that the lever shaft 66*a* cannot move to one side in the axial direction. (the right side of FIG. 9) Moreover, the cancel lever 66 is formed with a segment-shaped lever 66*b* extending toward the guide groove 45*g* at the upper side the guide groove 45*g* avoiding interference with the guide groove 45*g* and an elongated cam hole 66*c* is formed in a tip portion of the lever portion 66*b*. The cam hole 66*c* is bent so that one side of the cam hole 66*c* (the counterclockwise direction) is disposed on the side where the lever shaft 66*a* is positioned relative to the other side of the cam hole 66*c* in a circumferential direction. (the clockwise direction of FIG. 8)

A lever biasing spring 67 is coiled around the lever shaft 66*a* with one end of the lever biasing spring 67 supported by an inner wall surface located in one side of the encasement 45*c* (the clockwise direction of FIG. 8). The other end of the lever biasing spring 67 is engaged with the cancel lever 66, and the cancel lever 66 is biased in a counterclockwise direction in the figure. Further, an opposing surface of the lever portion 66*b* contacts a lever stopper 68, which is located in an inner wall of the other side of the encasement 45*c* (the counterclockwise direction of FIG. 8), and the rotation in the direction is restricted to hold the cancel lever 66 in a predetermined position.

A plate shaped cancel gear 69 is mounted in the guide groove 45*g* with the cancel gear 69 being movably in a radial direction of the recessed portion 45*d* arranged along the guide groove 45*g*. The cancel gear 69 is formed with an engaging pin 69*a* projecting in one direction (the front side positioned in a direction perpendicular to the paper of FIG. 8) to be inserted into the cam hole 66*c* and a plurality of gear side engaging detents 69*b* which is engageable with the engaging detents 58 in a tip portion of the recessed portion 45*d*. The engaging detents 58 face the guide groove 45*g*. As illustrated in FIG. 8 (*a*), in the state that the opposing face of the lever portion 66*b* contacts the lever stopper 68 and the cancel lever 66 is held in the predetermined position, the engaging pin 69*a* is pressed against an inner wall of the cam hole 66*c*, and the cancel lever 69 is forced out to the direction where the recessed portion 45*d* is located. Consequently, the gear side engaging detents 69*b* mesh the engaging detents 58 of the ring gear 55. At this moment, the ring gear 55 is engaged immovably. Meanwhile, as illustrated in FIG. 8 (*b*), in the state that the cancel lever 66 rotates in a clockwise direction of the figure against the lever biasing spring 67, the engaging pin 69*a* is pressed against the inner wall of the cam hole 66*c*, and the cancel lever 69 is pulled back to the side where the lever shaft portion 66*a* is positioned. Consequently, an engagement of the ring gear 55 with the engaging detents 58 is released. At this moment, the ring gear 55 becomes rotatable.

As illustrated in FIG. 7, a lever 70 which is made of a plate material is secured to a tip portion of the lever shaft portion 66*a* extending outward from the housing 44 (the case 45). In the housing 44, an end portion 72*a* of an outer tube 72 forming a cancel cable 71 is held at the upper side of the lever 70 and the lever 70 holds an end 73*a* of a wire 73 pulled from the end portion 72*a*. Therefore, when the wire 73 is pulled into the end portion 72*a*, the lever 70 rotates in a counterclockwise direction of the figure (the clockwise direction of FIG. 8) against the lever biasing spring 67 along with the cancel lever 66. The operational force of the door handle 4 and the door handle 5 is transmitted. Thus, the wire 73 (the cancel cable 71) is pulled into the end portion 72*a* so that the lever 70 rotates in the counterclockwise direction in the figure.

An operation of the actuator 40 will be described here. In the state that the ring gear 55 is immovably engaged by meshing between the engaging detents 58 and the gear side engaging detents 69*b*, the electrical motor 47 is driven and a rotational power in one direction (the clockwise direction of FIG. 8) is transmitted to the sun gear 51 (the worm wheel portion 54) meshing with the worm 48. The worm 48 is secured to the rotational shaft 47*a*. In response to the transmission of the rotational power, the sun gear portion 52 rotates in the direction. Thus, the planet gears 59 rotate on its axis in the other direction (the counterclockwise direction of FIG. 8) relative to the ring gear 55 and revolve in one direction (the clockwise direction of FIG. 8). The carrier 60 (the output shaft 49) outputs a rotational power in one direction (the clockwise direction of FIG. 8). In other words, the planet gear mechanism 50 forms a speed reducer. In the speed reducer, the sun gear 51 serves as an input shaft, the ring gear 55 serves as a fixed shaft, and the carrier 60 serves as an output shaft. In the situation, in response to the rotation of the output shaft 49, the driving lever 62 rotates in a counterclockwise direction in FIG. 7, and the driving wire 36 is pulled from the end portion 35*b*. The ring gear 55 receives a reaction force caused by the rotation of the carrier 60 and attempts to rotate in the other direction (the counterclockwise direction in FIG. 8), the cancel gear 69 rigidly restricts the rotation of the ring gear 55 in the direction.

Meanwhile, in the state that the engagement between the engaging detents 58 and the gear side engaging detents 69*b* is released and accordingly, the ring gear 55 becomes movable, the transmission of the output rotational power which is from the carrier 60 (the output shaft) is stopped. Due to large load occurred on the output shaft 49 side, the rotational power transmitted from the sun gear 51 to each planet gear 59 can rotate only the ring gear 55. Thus, each planet gear stops the revolution and the carrier 60 stops rotating. As a result, the transmission of the output rotational power is stopped.

As illustrated in FIG. 3, a cancel lever 76 is made of a plate material and served as a second lever member. The cancel lever 76 is rotatably supported around the second rotational axis 02 in the main body portion 11. The second rotational axis is eccentrically disposed in one side (the left side of FIG. 3) of the first rotational axis 01. The cancel lever 76 is eccentrically disposed in one side of the open lever 12 in an axial direction. (the front side positioned in a direction perpendicular to the paper of FIG. 3), and is formed with a cam portion 76 served as an engaging portion. The cam portion 76 is a cam plate and bends to the other side of the open lever 12 (the back side positioned in the direction perpendicular to the paper of FIG. 3) at the upper side of the end portion 12*b* so as to be disposed on a rotational path of the open lever 12. In other words, the cam portion 76*a* is projected to interrupt the rotational path of the open lever 12. The open lever 12 rotates in the clockwise direction in the figure about the first rotational axis 01. The cam portion 76*a* is then pressed and slidably contacted by a contact surface of the end portion 12*b*. Hence, the cancel lever 76 rotates about the second rotational axis 02 in the clockwise direction. In the state that the open lever 12 is held in the predetermined rotational position, which is illustrated in FIG. 3, the cam portion 76*a* is engaged with the end portion 12*b* of the open lever 12, and the cancel lever 76 is held in a predetermined rotational position around the second rotational axis 02. The cancel lever 76 is formed with a mounting strip 76*b* extending in one direction (the left side of FIG. 3) and raises the mounting strip 76*b* by rotating in a clockwise direction in the figure about the second rotational axis 02. As illustrated in FIG. 3, the first rotational axis 01 is within the outer periphery of the cancel lever 76, and the second rotational axis 02 is within the outer periphery of the open lever 12. FIG. 3 also illustrates that the open lever 12 and the cancel lever 76 overlap one another, in a direction perpendicular to the first rotational axis 01, in an overlapping area. In addition, the first rotational axis 01 and the second rotational axis 02 are located within that overlapping area.

In the main body portion 11, an end portion 72*b* of the outer tube 72 forming the cancel cable 71 is held at the lower side of the cancel lever 76. (the mounting strip 76*b*) The mounting strip 76*b* holds an end portion 73*b* of the wire 73 pulled from the end portion 72*b*. Therefore, when the cancel lever 76 rotates in the clockwise direction in the figure about the second rotational axis 02, the wire 73 is pulled from the end portion 72*b*. At that time, it is obvious that the wire 73 held on a side where the lever 70 is located is pulled into the end portion 72*a*. Thus, the cancel lever 66 rotates against the lever biasing spring 67, and the engagement of the gear side engaging detents 69*b* of the cancel gear 69 with the engaging detents 58 of the ring gear 55 is released to make the ring gear 55 rotatable. Even when either the door handle 4 or the door handle 5 is operated to open the door, the operational force is transmitted so as to raise the mounting strip 76*b* via the open lever 12. Hence, the ring gear 55 becomes rotatable and the output of the rotational power from the carrier 60 (the output shaft 49) is stopped. In other words, the cancel lever 76 forms a releasing means along with the cancel lever 66, the lever 70, the cancel cable 71 and other components. The reason that the ring gear 55 and the cancel lever 76 involving in the engagement and the disengagement of the cancel gear 69 is separated from the open lever to form different components is for avoiding influence on a return operation of the open lever 12, namely, return operations of the door handle 4 and the door handle 5 when a return operation of the cancel lever 76 is not performed properly. Furthermore, the reason that the rotational axis of the open lever 76 is eccentrically disposed relative to the rotational axis of the open lever 12 is for adjusting (increasing) the rotational distance (stroke) of the cancel lever 76 based on a predetermined allowable rotational distance of the open lever 12.

Figure 10:
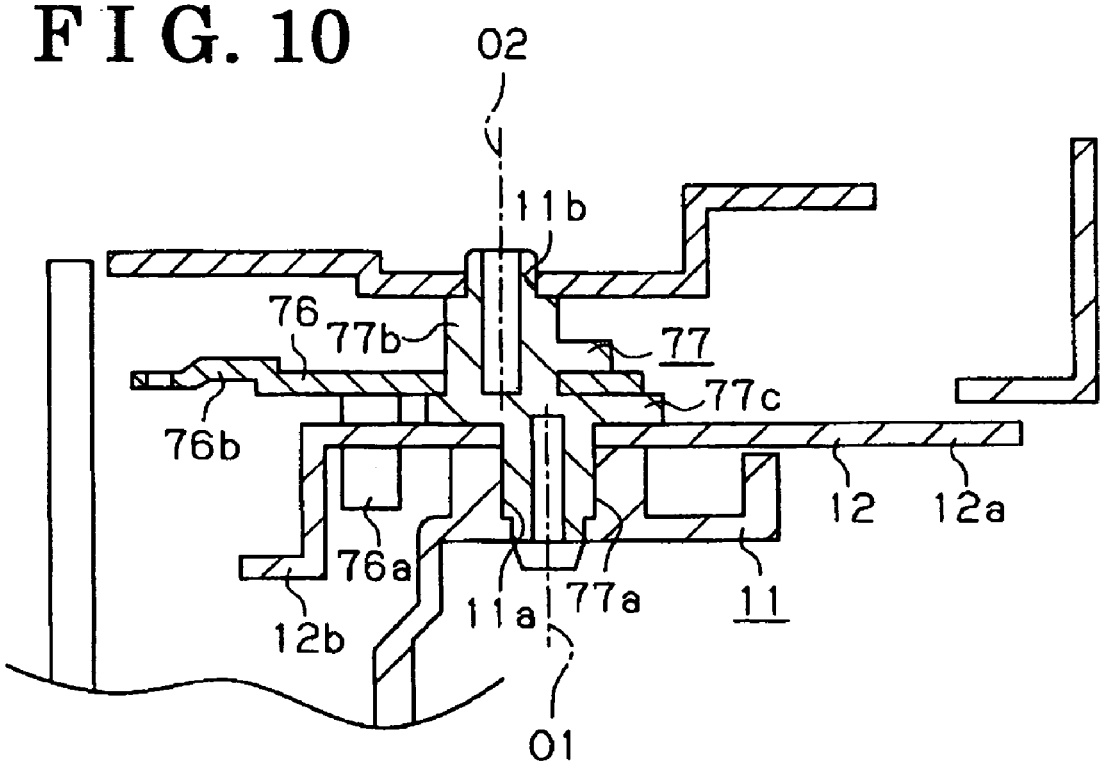
FIG. 10 is a cross sectional view taken from a line X-X of FIG. 3.

Supporting forms of the open lever 12 and the cancel lever 76 according to the embodiment will be described here. FIG. 10 is a cross sectional view taken along a line X-X of FIG. 3. As illustrated in the figure, a mounting hole 11*a* and a mounting hole 11*b* are formed in the main body portion 11. The mounting hole 11*a* has a common axis with the first rotational axis 01 and the mounting hole 11*b* has a common axis with the second rotational axis 02. The mounting holes 11*a* and 11*b* are roundly penetrated. A first axial portion 77*a* of a snap 77 served as a supporting member is pressed into and supported by the mounting hole 11*a* and a second axial portion 77*b* of the snap 77 is pressed into and supported by the mounting hole 11*b*. It is obvious that the first axial portion 77*a* should be disposed so as to have a common axis with the first rotational axis 01 and the second axial portion 77*b* should be disposed so as to have a common axis with the second rotational axis 02. The snap 77 is formed with a flange 77*c* extending radially outward at a boundary portion between the first axial portion 77*a* and the second axial portion 77*b*. As shown in FIG. 10, the snap 77 is separate from the main body portion 11, and is mounted on the main body portion 11.

The open lever 12 is penetrated by the first axial portion 77*a* in a way that the open lever 12 is contacted by an end surface on a first axial portion 77*a* side of the flange 77*c*. The open lever 12 is rotatably supported around the first axial portion 77*a* in a way that the open lever 12 cannot move in an axial direction. The cancel lever 76 is penetrated by the second axial portion 77*b* in away that the cancel lever 76 is contacted by an end surface on a second axial portion 77*b* side of the flange 77*c*. The cancel lever 76 is rotatably supported around the second axial portion in a way that the cancel lever 76 cannot move in the axial direction. Therefore, the open lever 12 and the cancel lever 76 are rotatably supported around the respective rotational axes.

Next, an operation according to the embodiment will be generally described. In the state that the vehicle door 1 is in the half closed state or the full closed state and the latch mechanism 20 is in the half latched state illustrated in FIG. 5 or the fill latched state illustrated in FIG. 6, when the outside door handle 4 is operated to open the vehicle door 1, the operational force is transmitted to the open lever 12. Thus, the open lever 12 rotates in the clockwise direction in FIG. 3 about the first rotational axis 01 to raise the end portion 12*b*. In the response to raising the end portion 12*b*, the open link 14 illustrated in FIG. 4 is raised. Consequently, the tip portion 15*a* of the lift lever 15 is pressed by the flange 14*a* of the open link 14 from the lower side. Thus, the lift lever 15 rotates and the pawl 24 unitary rotates with the lift lever 15 in the clockwise direction in FIG. 5 and FIG. 6, and the engagement of the engaging end portion 24*a* with the first engaging portion 21*d* or the second engaging portion 21*e* is released. Accordingly, the latch 21 is biased by the latch biasing spring 22 to press the striker 3 by the inner wall of the engaging recessed portion 21*a* and rotates in the clockwise direction in FIG. 5 and FIG. 6. Then, the vehicle door 1 disengages the striker 3 at the engaging recessed portion 21*a* to become openable.

Meanwhile, the inside door handle 5 is operated to open the door, the operational force is transmitted to the inside open lever 16. Thus, the inside open lever 16 rotates in the counterclockwise direction about the rotational axis 0 in FIG. 4 to raise the end portion 16*a* and the flange 14*a* of the open link 14 is pressed by the end portion 16*a* from the lower side. Thus, the open link 14 is raised and the pawl 24 rotates with the liver lever 15 in the form described above. Therefore, the vehicle door 1 disengages the striker 3 at the engaging recessed portion 21*a* to become openable in a similar manner. Even when the inside open lever 16 rotates, the open link 14 is raised. This allows the open lever 12 to rotate to raise the end portion 12*b*.

Next, in the state that the vehicle door 1 is in the half closed state and the latch mechanism 20 is in the half latched state illustrated in FIG. 5, when either the door handle 4 or the door handle 5 is not operated to open the door, and the ring gear 55 is unrotatably engaged (refer to FIG. 8 (*a*)) by the engagement between the engaging detents 58 and the gear side engaging detents 69*b*, the electrical motor 47 is driven and the rotational power in one direction (the clockwise direction in FIG. 8) is transmitted to the sun gear 51 (the worm wheel portion 54), and the carrier 60 (the output shaft 49) outputs the rotational power in one direction (the clockwise direction in FIG. 8) in the form described above. In response to the output, the driving lever 62 rotates in the counterclockwise direction in FIG. 7, and the driving wire 36 is pulled from the end portion 35*b* and pulled into the end portion 35*a* illustrated in FIG. 5. Therefore, the operational lever 31 rotates in the clockwise direction in FIG. 5, and the striker 3, which engages at the engaging recessed portion 21*a* in the form described above, is pulled resulting in the full latched state of the latch mechanism 20. Thus, the vehicle door 1 is operated to close the door from the half closed state to the full closed state.

After the operation of the vehicle door has been completed and the vehicle door is in the closed state, the electric motor 47 is driven reversely so that the driving lever 62, which unitary rotates with the output shaft 49 (the carrier 60), rotates in the clockwise direction in FIG. 7. At this time, the electric motor is driven under low load, and the ring gear 55 can be unrotatably engaged with the cancel gear 69 with smaller power. The operational lever 31 is biased by the lever biasing spring and rotates in the counterclockwise direction in FIG. 6 pulling the driving wire 36 from the end portion 35*a* to return to or be held (return to the initial state) at the predetermined rotational position wherein the rotation is restricted by the lever stopper 32.

Meanwhile, when either the door handle 4 or the door handle 5 is operated to open the vehicle door 1 while the electrical motor 47 is driving, namely, the vehicle door 1 is in the closing operation, the oven lever 12 rotates about the first rotational axis 01 to raise the end portion 12*b* by the transmission of the operational force. Thus, the cam portion 76*a* is pressed and slidably contacted by the contact surface of the end portion 12*b* and the cancel lever 76 rotates in the clockwise direction in FIG. 3 about the second rotational axis 02 to raise the mounting strip 76*b*. In response to the movement, the wire 73 is pulled from the end portion 72*b* and pulled into the end portion 72*a* illustrated in FIG. 7. Therefore, the cancel lever 66 rotates unitary with the lever 70 in the clockwise direction in FIG. 8, and the gear side engaging detents 69*b* of the cancel gear 69 disengages the engaging detents 58 of the ring gear 55 to make the ring gear 55 rotatable in the form described above. Consequently, the output of the rotational force from the carrier 60 (the output shaft 49) is stopped. It is obvious that the latch mechanism 20 can be put into the unlatched state by operating the door handle 4 or the door handle 5 to open the door. In this situation, the operation lever 31, which engages with the latch 21 (the projecting follower portion 21*f*) to switch the latch mechanism 20 from the half latched state to the full latched state, allows the latch mechanism 20 to enter the unlatched state because the transmission of the power using the planet gear mechanism is blocked. As a result, the vehicle door 1 becomes openable.

Further, in this state, when the operational force of the door handle 4 or the door handle 5 is released, the cancel lever 66 is biased by the lever biasing spring 67 to return the predetermined rotational position and the cancel gear 69 moves along the guide groove 45*b* in a way that the gear side engaging detents 69*b* mesh the engaging detents 58 of the ring gear 55, and the ring gear 55 is unrotatably engaged again. Additionally, in response to the rotation of the cancel lever 66, the lever 70 rotates in the clockwise direction in FIG. 7, the wire 73 is pulled from the end portion 72*a* and pulled into the end portion 72*b* illustrated in FIG. 3 and the cancel lever 76 rotates in the counter clockwise direction in FIG. 3. Accordingly, the cancel lever 76 returns to or is held at the predetermined rotational position wherein the cam portion 76*a* is engaged with the end portion 12*b* of the open lever 12.

As described above in detail, according to the embodiment, the following effect can be achieved.

(1) In the embodiment, the cancel lever 76 engages with the open lever 21 at the cam portion 76*a*. The cancel lever 76 rotates in one direction about the second rotational axis 02 in response to the rotation of the open lever 12 about the first rotational axis 01 to block the transmission of the driving force from the actuator 40 to the latch mechanism 20. In the situation, the rotational distance (stroke) of the cancel lever 76 is adjusted (increased) relative to the rotational distance of the open lever 12 with the distance of the eccentricity between the first rotational axis 01 and the second rotational axis 02. With a very simple structure wherein the first rotational axis 01 is eccentrically disposed relative to the second rotational axis 02, the rotational distance for the cancel lever 76, which is necessary for blocking the transmission of the driving force from the actuator 40 to the latch mechanism 20, can be attained within an allowable rotational distance (stroke) of the open lever 12 to put the latch mechanism 20 into the unlatched state. Thus, the increase in the number of components and the increase of the production processes are restricted. As a result, the reduction in the costs for components and assemblies is achieved.

(2) In the embodiment, the open lever 12 is rotatably supported around the first axial portion 77*a* of the snap 77 to rotate the first rotational axis 01, and the cancel lever 76 is rotatably supported around the second axial portion 77*b* of the snap 77 to rotate the second rotational axis 02. Thus, with a very simple structure which is provided with the snap 77, the open lever 12 and the cancel lever 76 can rotate about each rotational axis (the first rotational axis 01 and the second rotational axis 02).

(3) In the embodiment, the cancel lever 76 can engage with the open lever 12 with a simple form which has only the cam portion 76*a*, which is made of a plate material, pressed by the open lever 12.

(4) In the embodiment, the rotational distance (stroke) which is necessary for the cancel lever 76 can be secured by increasing the width of the rotational distance of the open lever 12 without extending the rotational distance (stroke) of the open lever 12. Thus, the accommodation capacity within the vehicle door 1, where a space is limited, is improved. Particularly, in the vehicle width direction, where the space is extremely limited, the device satisfies both of securing the rotational distance (stroke) for the cancel lever 76 and the accommodation capacity.

The embodiment described above may be changed as follows.

In the embodiment, the snap 77 is employed to rotate the open lever 12 and the cancel lever 76 about respective rotational axes. However, a structure of eccentric cam may be used alternatively.

In the embodiment, an engaging pin functioning in the same manner as the cam portion 76*a* may be projected in the cancel lever 76 to engage with the open lever 12. In the embodiment, the rotational distance (stroke) of the cancel lever 76 may be adjusted to be shortened based on the predetermined rotational distance allowed by the open lever 12.

The invention claimed is:

1. A door closing apparatus comprising:

a main body portion;

a latch mechanism positioned in the main body portion and operable for opening or closing a door of a vehicle, the latch mechanism being at a half latched state at a time that the door is half closed, the latch mechanism being at a full latched state at a time that the door is fully closed, and the latch mechanism being at an unlatched state at a time that the door is open;

a driving mechanism transmitting a driving force to the latch mechanism to operate the latch mechanism;

a first lever rotatably disposed about a first rotational axis and rotating in one direction about the first rotational axis in response to transmission of an operation force of a door handle to the first lever so that the latch mechanism is controlled at the unlatched state;

a second lever having an engaging portion which engages with the first lever and rotatably disposed about a second rotational axis parallel to the first rotational axis, the second lever rotating in the one direction about the second rotational axis in response to a rotation in the one direction of the first lever to interrupt transmission of the driving force from the driving mechanism to the latch mechanism; and a support member separate from the main body portion and mounted on the main body portion, the support member having a first axial portion rotatably supporting the first lever about the first rotational axis and a second axial portion rotatably supporting the second lever about the second rotational axis, the first axial portion being eccentrically arranged with respect to the second axial portion, the first axial portion and the second axial portion being integrally formed as one piece, the first and second axial portions extending in opposite directions.

2. A door closing apparatus according to claim 1, wherein the support member comprises a flange extending radially outward at a boundary portion between the first axial portion and the second axial portion.

3. A door closing apparatus according to claim 1, wherein the engaging portion is a cam plate portion pressed by the first lever in response to the rotation of the first lever in one direction about the first rotational axis.

4. A door closing apparatus according to claim 2, wherein the engaging portion is a cam plate portion pressed by the first lever in response to the rotation of the first lever in one direction about the first rotational axis.

5. A door closing apparatus according to claim 2, wherein the first axial portion passes through a hole in the first lever, and the first lever is contacted by an end surface of the flange on a first axial portion side of the flange, the first lever being immovable in an axial direction, and the second axial portion passes through a hole in the second lever, and the second lever is contacted by an end surface on a second axial portion side of the flange.

6. A door closing apparatus according to claim 1, wherein the main body portion includes a wall provided with first and second spaced apart through holes, wherein the support member includes a snap portion, and the first axial portion and the second axial portion are positioned in the first and second through holes in the wall of the main body portion.

7. A door closing apparatus according to claim 1, wherein the first rotational axis is within an outer periphery of the second lever, and the second rotational axis is within an outer periphery of the first lever.

8. A door closing apparatus according to claim 2, wherein the first rotational axis is within an outer periphery of the second lever, and the second rotational axis is within an outer periphery of the first lever.

9. A door closing apparatus according to claim 1, wherein the first lever and the second lever having an overlapping area overlapping in a perpendicular direction to the first rotational axis, the first rotational axis and the second rotational axis being within the overlapping area.

10. A door closing apparatus according to claim 2, wherein the first lever and the second lever having an overlapping area overlapping in a perpendicular direction to the first rotational axis, the first rotational axis and the second rotational axis being within the overlapping area.

11. A door closing apparatus according to claim 1, wherein the first lever is an open lever, and the second lever is a cancel lever.

12. A door closing apparatus according to claim 2, wherein the first lever is an open lever, and the second lever is a cancel lever.

13. A door closing apparatus comprising:

a latch mechanism operated to open or close a door of a vehicle, the latch mechanism being at a half latched state at a time when the door is half closed, the latch mechanism being at a full latched state at a time when the door is fully closed, and the latch mechanism being at an unlatched state at a time when the door is open;

a driving mechanism transmitting a driving force to the latch mechanism to operate the latch mechanism;

a first lever rotatably disposed about a first rotational axis and rotating in one direction about the first rotational axis in response to transmission of an operation force of a door handle to the first lever so that the latch mechanism is controlled at the unlatched state;

a second lever having an engaging portion which engages with the first lever, the second lever being rotatably disposed about a second rotational axis parallel to the first rotational axis, the second lever rotating in the one direction about the second rotational axis in response to rotation of the first lever in the one direction to interrupt transmission of the driving force from the driving mechanism to the latch mechanism;

the first and second levers being positioned in a main body portion; and a support member separate from and mounted on a wall of the main body portion, the support member having a first axial portion rotatably supporting the first lever about the first rotational axis and a second axial portion rotatably supporting the second lever about the second rotational axis, the first axial portion being offset from the second axial portion, the first axial portion and the second axial portion being formed integrally as one piece, the first and second axial portions extending in opposite directions.

* * * * *